US009340852B2

(12) United States Patent
Chen

(10) Patent No.: US 9,340,852 B2
(45) Date of Patent: May 17, 2016

(54) ELEVATED REFRACTORY ALLOY WITH AMBIENT-TEMPERATURE AND LOW-TEMPERATURE DUCTILITY AND METHOD THEREOF

(75) Inventor: Swe-Kai Chen, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 1219 days.

(21) Appl. No.: 13/245,284

(22) Filed: Sep. 26, 2011

(65) Prior Publication Data

US 2013/0078133 A1 Mar. 28, 2013

(51) Int. Cl.
*C22C 1/10* (2006.01)
*C22C 29/06* (2006.01)

(52) U.S. Cl.
CPC ..... *C22C 1/1084* (2013.01); *C22C 29/06* (2013.01); *B22F 2998/10* (2013.01)

(58) Field of Classification Search
CPC . C01P 2002/70; C01P 2002/77; C22C 1/045; C22C 1/0458; C22C 1/05; C22C 1/051; C22C 1/053; C22C 1/055; C22C 1/058; C22C 1/10; C22C 1/068; C22C 49/10; C22C 49/11; C22C 2200/00; C22F 1/18; C22F 1/183; C22F 1/186; B22F 2301/20; B22F 2301/205; B22F 2302/10; B22F 2302/15; B22F 2302/35
See application file for complete search history.

(56) References Cited

U.S. PATENT DOCUMENTS

| | | | | |
|---|---|---|---|---|
| 4,066,451 | A | 1/1978 | Rudy | |
| 4,432,794 | A * | 2/1984 | Holleck | 75/239 |
| 2008/0031769 | A1 * | 2/2008 | Yeh | 420/580 |
| 2008/0257107 | A1 | 10/2008 | Liu | |

FOREIGN PATENT DOCUMENTS

| | | | |
|---|---|---|---|
| CN | 1490423 | A | 7/2003 |
| TW | 279445 | I | 1/1993 |

OTHER PUBLICATIONS

"Refractory Metals and Alloys," ASM Handbook, vol. 20, ASM International, 1997, pp. 409-414.*

(Continued)

*Primary Examiner* — Scott Kastler
*Assistant Examiner* — Vanessa Luk
(74) *Attorney, Agent, or Firm* — Ming Chow; Sinorica, LLC

(57) ABSTRACT

An elevated refractory alloy with ambient-temperature and low-temperature ductility and the method thereof is disclosed, that is, at least four high-melting point metal elements are composed with at least four carbides of the high-melting point metal elements through a high-temperature alloy process, the carbides is dissolved in the high-melting point metal elements, therefore the high-melting point metal elements are wet and composed with the carbides, consequently the crystallographic structure composed by the high-melting point metal elements and the carbides is changed from a body-centered cubic structure to a face-centered cubic structure. Therefore, at least four high-melting point metal elements are composed with corresponding carbides of the four high-melting point metal elements and an alloy material is made through high-temperature, wherein the crystallographic structure of the alloy material is a face-centered cubic structure so as to let that the alloy material is convenient machined.

6 Claims, 2 Drawing Sheets

(56) References Cited

OTHER PUBLICATIONS

O.N. Senkov and C.F. Woodward, "Microstructure and properties of a refractory NbCrMo(sub.0.5)Ta(sub.0.5)TiZe alloy," Materials Science and Engineering A, 529, published online Sep. 16, 2011, pp. 311-320.*

O.N. Senkov, G.B. Wilks, D.B. Miracle, C.P. Chuang, P.K. Liaw, Refractory high-entropy alloys, Intermetallics, vol. 18, Issue 9, Sep. 2010, P1758-P1765.

* cited by examiner

ELEVATED REFRACTORY ALLOY WITH AMBIENT-TEMPERATURE AND LOW-TEMPERATURE DUCTILITY AND METHOD THEREOF

BACKGROUND OF THE INVENTION

1. Field of the Invention

The present invention generally relates to an elevated refractory alloy with ambient-temperature and low-temperature ductility and a method thereof, more particularly, at least four high-melting point metal elements are composed with at least four carbides of the high-melting point metal elements through a high-temperature alloy process so as to produce the elevated refractory alloy with ambient-temperature and low-temperature ductility.

2. Description of the Prior Art

Nowadays, US Air Force Lab has developed high intensity alloy that has tungsten (chemical symbol is W, melting point is 3380° C.), tantalum (chemical symbol is Ta, melting point is 2996° C.), molybdenum (chemical symbol is Mo, melting point is 2620° C.), niobium (chemical symbol is Nb, melting point is 2468° C.), and vanadium (chemical symbol is V, melting point is 1730° C.) and is categorized into two parts, body-centered cubic structure with 4-element W—Nb—Mo—Ta and body-centered cubic structure with 5-element W—Nb—Mo—Ta—V. (please refer to attachment 1, Refractory high-entropy alloys, Intermetallics 18 (2010) 1758-1765)

Such elements as tungsten (chemical symbol is W, melting point is 3380° C.), tantalum (chemical symbol is Ta, melting point is 2996° C.), molybdenum (chemical symbol is Mo, melting point is 2620° C.), niobium (chemical symbol is Nb, melting point is 2468° C.), rhenium (chemical symbol is Re, melting point is 3180° C.) and vanadium (chemical symbol is V, melting point is 1730° C.) are body-centered cubic structures except rhenium under ambient-temperature, wherein rhenium is a hexagonal to closed-packed structure (HCP).

The crystallographic structures of aforesaid elements are characterized in that of high-temperature resistance, high ductile-to brittle transition temperature, as an example, tungsten reaches over 300° C. Hence, the elements are very intensive under ambient-temperature so as to hardly be rolled, forged, plastic-deformed, working-deformed, etc. Even though US Air Force Lab has developed such high intensity alloy, the disadvantages of the alloy are body-centered cubic structure, not ductile under low-temperature, so that manufacturers for alloy products are inconvenient.

Further, other information to the high-temperature resistant alloys are as below:

1. Issue No. TW I279445 and Publication No. US 20080257107 provide hardmetal compositions, which include hard particles having a first material and a binder matrix having a second, different material comprising rhenium or a Ni-based superalloy. A two-step sintering process may be used to fabricate such hardmetals at relatively low sintering temperatures in the solid-state phase to produce substantially fully-densified hardmetals. However, the two cited prior arts, TW I279445 and US 20080257107, produce the hardmetals that are to increase the strength and intensity, so that the means thereof is totally different than the present invention.
2. Issue No. TW I298657 provides a method for manufacturing metallic glass matrix composition material. Firstly, a high power ball mill machine is used to process a process of mechanical alloying. That is, metallic glass matrix composition powder and milling tanks are disposed in a vibration ball mill machine, a planet ball mill machine, or a stirring ball mill machine so as to produce the metallic glass matrix composition material powder that has a super cool liquid region, which is defined by a temperature difference of a glass transition temperature and a crystallization temperature. The metallic glass matrix composition material powder with the super cool liquid region is thus disposed in a thermoforming device and heated up to and kept in the temperature scope of the super cool liquid region. Within the period of keeping temperature, to continuously compress the powder is to increase the porosity the embryonic body of the powder, so that the bulk of the metallic glass matrix composition material is gained, and the bulk is composed by amorphous matrix composites and carbide strengthening. However, the cited prior art, TW I298657, adopts the amorphous matrix composition material that is a random internal atomic arrangement or not including crystallographic structures, hence the present invention is totally different than the cited prior art.
3. Issue No. CN 1490423A, a method for manufacturing tungsten carbide base that is high-temperature and adhesive resistant, adopts bonding phase powder master alloy, and Co-base wrought superalloy is the base of the bonding phase powder master alloy and includes the elements of cobalt (Co), Chromium (Cr), Nickel (Ni), tungsten (W), aluminum (Al), etc., elements damaging the performances of hardmetal alloys shall be eliminated and elements urging an oxide adhesion layer on the surface of the alloy within the process of machining the hardmetal alloy are added into. However, the means and purposes of the cited prior art, CN 1490423A, are completely different than the present invention.
4. Issue No. U.S. Pat. No. 4,066,451 is talking about carbide compositions for wear-resistant facings, which are consisted of fine-grained and hard two-phase mixtures of subcarbide, (Mo,W).sub.2 C, and hexagonal monocarbide (Mo,W)C, and solid solutions, and are formed by solid state decomposition of the pseudocubic. On the other hand, the present invention adopts a high-temperature process of composing high-melting point metal elements and carbides corresponding to the high-melting point metal elements. However, the means and purposes of the cited prior art, U.S. Pat. No. 4,066,451, are completely different than the present invention.

Accordingly, to provide an elevated refractory alloy with ambient-temperature and low-temperature ductility and a method thereof may be a best solution.

SUMMARY OF THE INVENTION

The main objective of the present invention is to provide an elevated refractory alloy with ambient-temperature and low-temperature ductility and a method thereof, that is, while the alloy material is manufactured by a high-temperature process, the alloy is a face-centered cubic structure so as to let that the alloy is convenient to be machined, such as rolling, forging, plastic deformation, etc.

The other objective of the present invention is to provide the elevated refractory alloy with ambient-temperature and low-temperature ductility and the method thereof, that is, through composing high-melting point metal elements with corresponding carbides, the crystallographic structures of the original high-melting point metal elements are thus changed to face-centered cubic structures.

To achieve above objectives of the elevated refractory alloy with ambient-temperature and low-temperature ductility and the method thereof, at least four high-melting point metal elements are composed with at least four carbides of the high-melting point metal elements through a high-temperature alloy process, the carbides can be dissolved in the high-melting point metal elements, so that the high-melting point metal elements are wet and composed with the carbides, consequently the crystallographic structure composed by the high-melting point metal elements and the carbides is changed from a body-centered cubic structure to a face-centered cubic structure. Therefore, at least four high-melting point metal elements are composed with corresponding carbides of the four high-melting point metal elements and an alloy material is made through high-temperature, wherein the crystallographic structure of the alloy material is a face-centered cubic structure so as to let that the alloy material is convenient to be machined, such as rolling, forging, plastic deformation, etc.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects.

Figure 1:
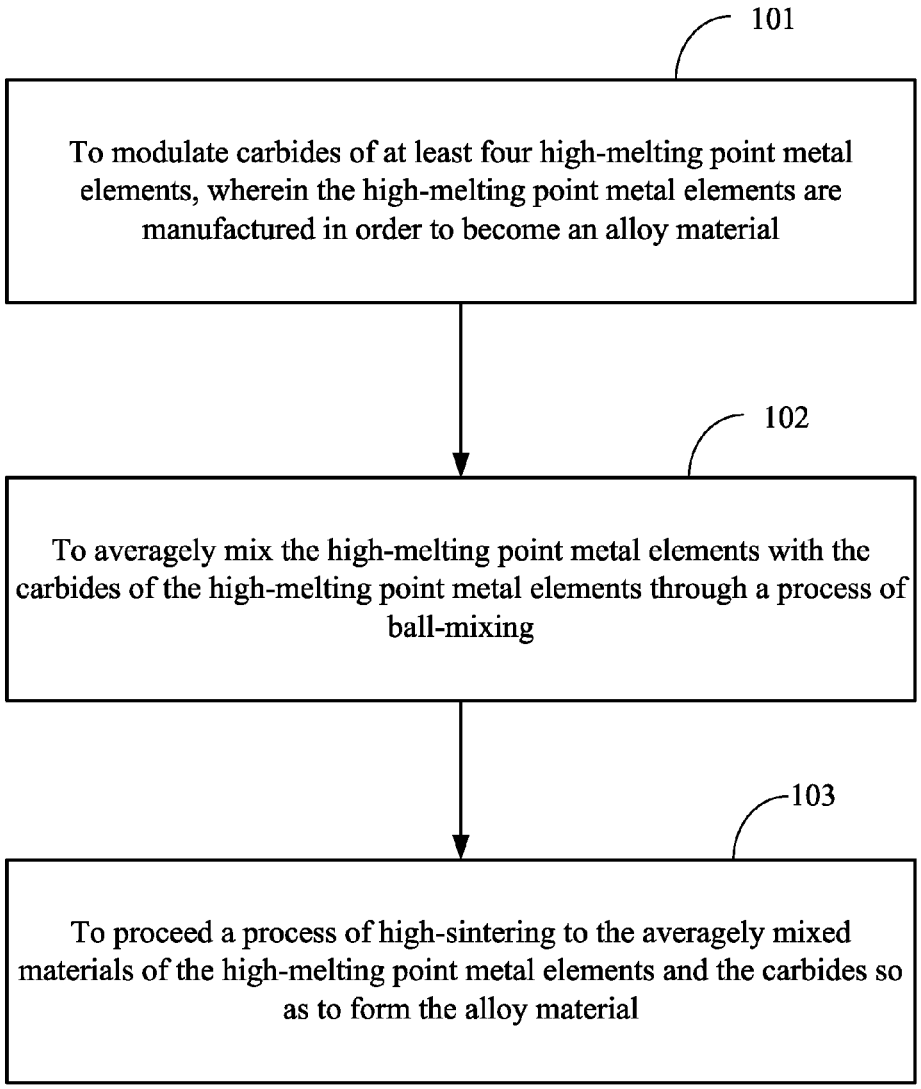
FIG. 1 illustrates a flow chart of a method for manufacturing an elevated refractory alloy with ambient-temperature and low-temperature ductility of the present invention; an FIG. 2 illustrates an X-ray diffraction measurement chart of the elevated refractory alloy with ambient-temperature and low-temperature ductility and the method thereof of the present invention.

FIG. 1 illustrates a flow chart of a method for manufacturing an elevated refractory alloy with both ambient-temperature and low-temperature ductility of the present invention. With reference to FIG. 1, the method includes the steps of:

(101) to modulate carbides of at least four high-melting point metal elements, wherein the high-melting point metal elements are manufactured in order to become an alloy material, the mole ratio of the high-melting point metal elements and the corresponding carbides of the high-melting point metal elements is 1:1 (due to that the mole ratio may affect the crystallographic structure after composition, to modulate carbides with face-centered cubic structure is a must);

(102) to averagely mix the high-melting point metal elements with the carbides of the high-melting point metal elements through a process of ball-mixing; and (103) to process a process of high-sintering to the averagely mixed materials of the high-melting point metal elements and the carbides so as to form the alloy material.

Preferably, the carbides can be dissolved in the high-melting point metal elements, so that the high-melting point metal elements are wet and composed with the carbides, consequently the ratio of the high-melting point metal elements and the carbides results in that of the crystallographic structure composed by the high-melting point metal elements and the carbides being a face-centered cubic structure or body-centered cubic structure.

Preferably, the high-melting point metal element is a body-centered cubic structure, so that the alloy shall be a body-centered cubic structure as well. Continuously, while the high-melting point metal element composes the carbide that is a face-centered cubic structure, the composed material may be a face-centered cubic structure, and a final composed alloy material will be a face-centered cubic crystal structure either.

Preferably, the high-melting point metal elements are tungsten, tantalum, molybdenum, niobium, vanadium, titanium, and the likes that are with high-melting points. The high-melting point metal elements are body-centered cubic structures under ambient-temperature. The body-centered cubic structure has cubic unit cells, and the atoms of cubic unit cell are disposed at eight corners, further that, a complete series of atoms are disposed in the center of the cubic structure.

Preferably, the carbides, such as WC, TaC, MoC, NbC, VC, and TiC, of the high-melting point metal elements are face-centered cubic structures (FCC). The face-centered cubic structure has cubic geometric unit cells, and the atoms are distributed at every corners and the centers of all surfaces of each cell. Such carbides are high-melting point materials.

Preferably, the process of ball-mixing for mixing the high-melting point metal elements with the carbides of the high-melting point metal elements in step (102) is mechanical alloying, which is to rotate balls with high power, called ball mill or ball grinder, to deform metal powder, such that the metal powder may continuously produce atomic planes, then layer structures are generated due to consequent bonding. With the increase of the ball mill time, the layer structures will be continuously refined status and the diffusion distances among solid particles will be shortened. Therefore the characteristics of the original powder are gradually disappeared and the speed to alloy solid metal is increased. The preferred embodiment of the present invention adopts the mole ratio the materials of the high-melting point metal elements and the corresponding carbides is 1:1, consequently the materials are grinded by ball mill about 24-48 hours, thereafter new carbide is produced.

Preferably, the process of high-sintering in step (103) is arc-melting or powder metallurgy to manufacture WC—Co and TiC—Ni. The descriptions are listed below:

1. Arc-melting: Arc generated between Graphite electrode and furnace charge heats the furnace charge in order to let the furnace charge be melted to liquid. Generally speaking, arc-melting is to manufacture metal materials with high-melting points.
2. Powder metallurgy to manufacture WC—Co and TiC—Ni: WC—Co and TiC—Ni are two alloys with thermostability and high degree of hardness and manufactured by powder metallurgy, wherein the basic process for WC—Co is to mix 90% WC with 10% Co, then process the mixed material with liquid phase sintering, and same way to TiC—Ni.

Figure 2:
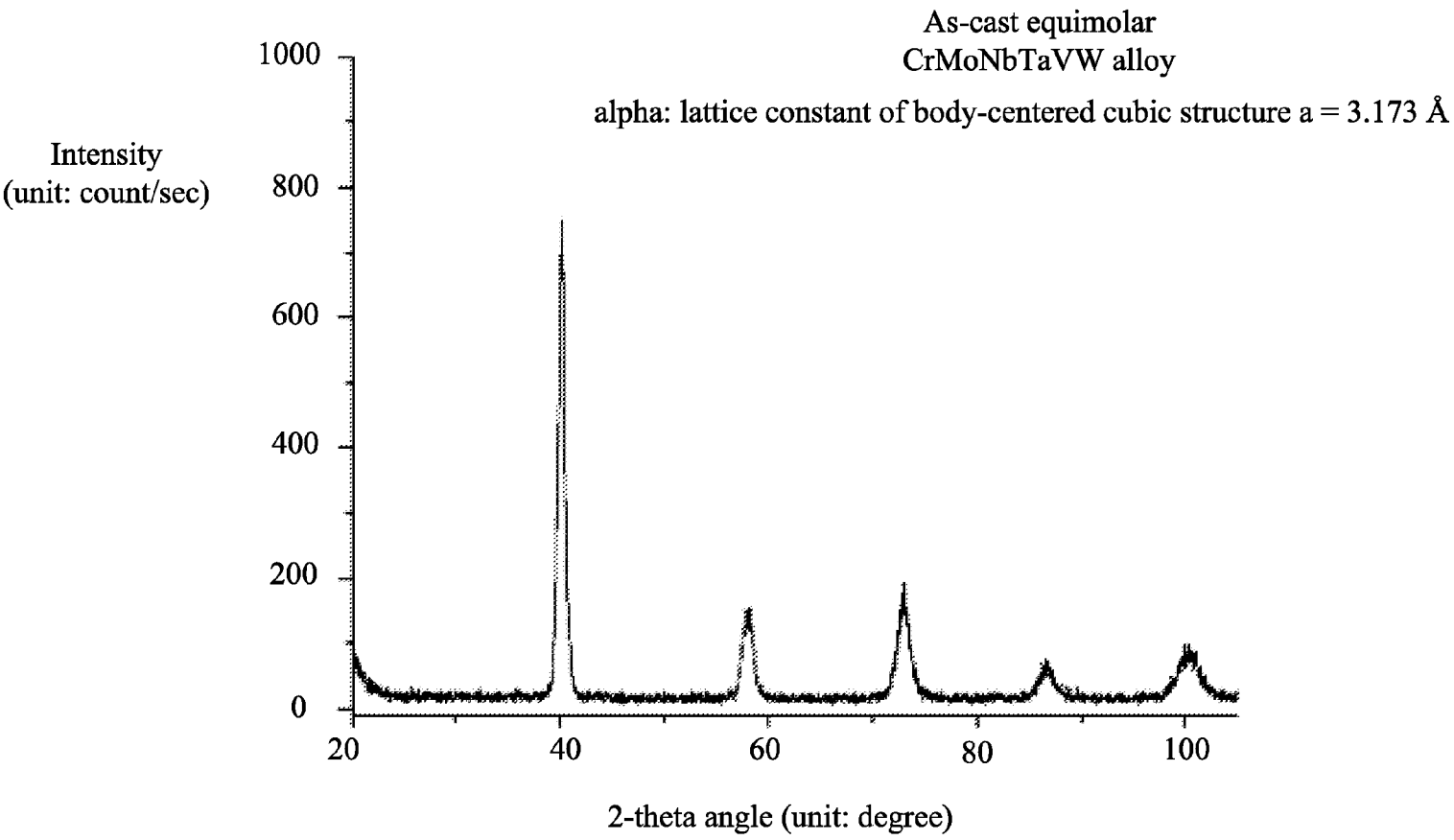

FIG. 2 illustrates an X-ray diffraction measurement chart of the elevated refractory alloy with ambient-temperature and low-temperature ductility and the method thereof of the present invention. As shown in FIG. 2, a face-centered cubic structure, CrMoNbTaVW, is manufactured by the flow chart in FIG. 1, thus an X-ray diffraction measurement instrument (XRD) is applied to measure the face-centered cubic structure. After measuring and analyzing, the peak value and the full width at half maximum (FWHM) are determined by the built-in software in the XRD. The dimensions of a grain is determined by Scherrer's formula listed below:

$$\text{Grain size} = \frac{0.9\lambda}{B\cos\Theta_B} \quad (1)$$

$$B = FWHM = \frac{1}{2}(2\theta_H - 2\theta_L) = \theta_H - \theta_L \quad (2)$$

wherein grain size represents dimension of grain, $\lambda_{Cu}$ represents wavelength of X-ray and the value is 1.5408 nm, β represents FWHM of diffraction peak, and $\Theta_B$ represents angle of diffraction peak. The results of peak angle, intensity, relative intensity, FWHM, grain size of CrMoNbTaVW are listed below, as shown in Table 1:

| data | plane | $2^{nd}$ peak angle | $1^{st}$ peak angle | intensity | relative intensity ($I_x/I_1$) | relative intensity ($I_x/I_5$) | FWHM | grain size (μm) |
|---|---|---|---|---|---|---|---|---|
| 1 | (110) | 40.076 | 20.038 | 690 | 1.000 | 9.718 | 0.356 | 237.6 |
| 2 | (200) | 57.930 | 28.965 | 147 | 0.213 | 2.070 | 0.730 | 124.4 |
| 3 | (211) | 72.950 | 36.475 | 173 | 0.251 | 0.410 | 0.690 | 143.2 |
| 4 | (220) | 86.720 | 43.360 | 64 | 0.093 | 0.901 | 0.990 | 110.4 |
| 5 | (310) | 100.130 | 50.065 | 71 | 0.103 | 1.000 | 0.990 | 125.0 |

The results of determined atomic radius, lattice constant of body-centered cubic structure of pure element, and converted effective atomic radius of CrMoNbTaVW are listed below, as shown in Table 2:

| element | determined atomic radius (Å) | actual atomic radius (Å) | lattice constant of body-centered cubic structure of pure element (Å) | converted effective atomic radius (Å) |
|---|---|---|---|---|
| Cr | 1.66 | 1.40 | 2.8847 | 1.249 |
| Mo | 1.90 | 1.45 | 3.1469 | 1.363 |
| Nb | 1.98 | 1.45 | 3.3067 | 1.432 |
| Ta | 2.00 | 1.45 | 3.2980 | 1.428 |
| V | 1.71 | 1.32 | 3.0232 | 1.310 |
| W | 1.93 | 1.32 | 3.1653 | 1.371 |
| CrMoNbTaVW | | | 3.1730 | 1.374 |

Compared with prior arts, the elevated refractory alloy with ambient-temperature and low-temperature ductility and the method thereof provided by the present invention has following advantages:

1. After the alloy material is manufactured by a high-temperature process, the alloy is a face-centered cubic structure so as to let that the alloy is convenient to be machined, such as rolling, forging, plastic deformation, etc.
2. Through composing high-melting-point metal elements with corresponding carbides, the crystallographic structures of the original high-melting-point metal elements are thus changed to face-centered cubic structures. Hence, while composing at least four high-melting-point metal elements with corresponding four carbides, an alloy material with face-centered cubic structure is manufactured.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A refractory alloy with ambient-temperature ductility comprising:

metal elements including chromium, titanium, vanadium, niobium, molybdenum, tantalum, nickel, cobalt, and tungsten;

corresponding carbides of the metal elements having face-centered cubic structure;

the carbides being dissolved in the metal elements so that the metal elements are wetted and composed with the carbides;

the crystallographic structure of the metal elements is a body-centered cubic structure prior to being alloyed;

the crystallographic structure of the alloy is a face-centered cubic structure;

the alloy having a grain size of 125.0 to 237.6 μm;

the alloy having an atomic radius of 1.249-1.432 Å;

the alloy being made by the process of:

(a) modulating carbides of the metal elements, the metal elements being manufactured to become the alloy, the molar ratio of the metal elements and the carbides being one to one;

(b) averagely mixing the metal elements with the carbides through a process of ball-mixing by mechanical alloying;

(c) sintering the averagely mixed metal elements and carbides to form the refractory alloy.

2. A method for manufacturing the refractory alloy with ambient-temperature ductility according to claim 1, comprising the steps of:

(a) modulating carbides of the metal elements, the metal elements being manufactured to become the alloy, the molar ratio of the metal elements and the carbides being one to one to modulate carbides of the metal elements, wherein the metal elements are manufactured in order to become an alloy material;

(b) averagely mixing the metal elements with the carbides through a process of ball-mixing by mechanical alloying to averagely mix the metal elements with the carbides of the high-melting point metal elements through a process of ball-mixing; and (c) sintering the averagely mixed metal elements and carbides to form the refractory alloy to proceed a process of high-sintering to the averagely mixed materials of the metal elements and the carbides so as to form the alloy material.

3. The method for manufacturing the refractory alloy with ambient-temperature ductility according to claim 2, wherein the carbides can be dissolved in the metal elements, so that the metal elements are wet and composed with the carbides, consequently the crystallographic structure composed with the carbides, consequently the crystallographic structure composed by the high-melting point metal elements and the carbides is a face-centered cubic structure.

4. The method for manufacturing the refractory alloy with ambient-temperature ductility according to claim 2, wherein after the metal elements and the carbides of the metal elements are composed, a final composed alloy material is a face-centered cubic crystal structure.

5. The method for manufacturing the refractory alloy with ambient-temperature ductility according to claim 2, wherein the process of high-sintering is to use powder metallurgy to manufacture WC—Co.

6. The method for manufacturing the refractory alloy with ambient-temperature ductility according to claim 2, wherein the process of high-sintering is to use powder metallurgy to manufacture TiC—Ni.

* * * * *